US006896075B2

(12) United States Patent
Haugen et al.

(10) Patent No.: US 6,896,075 B2
(45) Date of Patent: May 24, 2005

(54) APPARATUS AND METHODS FOR DRILLING WITH CASING

(75) Inventors: David M. Haugen, League City, TX (US); Frederick T. Tilton, Spring, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 92 days.

(21) Appl. No.: 10/269,661

(22) Filed: Oct. 11, 2002

(65) Prior Publication Data

US 2004/0069501 A1 Apr. 15, 2004

(51) Int. Cl.[7] ..... E21B 7/00; E21B 21/00

(52) U.S. Cl. ..... 175/57; 166/77.1; 166/242.1; 166/380; 166/381; 175/324

(58) Field of Search ..... 166/380, 242.1, 166/381, 105, 77.1; 175/57, 324

(56) References Cited

U.S. PATENT DOCUMENTS

| | | | | |
|---|---|---|---|---|
| 1,185,582 A | * | 5/1916 | Bignell | 405/248 |
| 1,301,285 A | | 4/1919 | Leonard | |
| 1,342,424 A | | 6/1920 | Cotten | |
| 1,842,638 A | | 1/1932 | Wigle | |
| 1,880,218 A | | 10/1932 | Simmons | |
| 1,917,135 A | | 7/1933 | Littell | |
| 1,981,525 A | | 11/1934 | Price | |
| 2,017,451 A | | 10/1935 | Wickersham | |
| 2,049,450 A | | 8/1936 | Johnson | |
| 2,060,352 A | | 11/1936 | Stokes | |
| 2,214,429 A | | 9/1940 | Miller | |
| 2,216,895 A | | 10/1940 | Stokes | |
| 2,295,803 A | | 9/1942 | O'Leary | |
| 2,324,679 A | | 7/1943 | Cox | |
| 2,499,630 A | | 3/1950 | Clark | |

(Continued)

FOREIGN PATENT DOCUMENTS

| | | |
|---|---|---|
| DE | 3 213 464 | 10/1983 |
| DE | 4 133 802 | 10/1992 |
| EP | 0 235 105 | 9/1987 |
| EP | 0 265 344 | 4/1988 |
| EP | 0 462 618 | 12/1991 |

(Continued)

OTHER PUBLICATIONS

Hahn, et al., "Simultaneous Drill and Case Technology—Case Histories, Status and Options for Further Development," Society of Petroleum Engineers, IADC/SPE Drilling Conference, New Orlean, LA Feb. 23–25, 2000 pp. 1–9.

(Continued)

*Primary Examiner*—Hoang Dang
(74) *Attorney, Agent, or Firm*—Moser, Patterson & Sheridan, L.L.P.

(57) ABSTRACT

The present invention provides an apparatus and methods to reduce ECD and pressure associated therewith while drilling with casing. In one aspect, the invention provides an energy transfer assembly locatable at a predetermined location in a casing string. The assembly includes an impeller portion in the interior of the casing to be acted upon by the downward moving fluid in the casing and a pump portion disposed outwardly of the impeller portion and arranged in fluid communication with the upward moving fluid in the annulus between the casing and the borehole, adding energy thereto and reducing pressure in the annulus therebelow. In another aspect, the energy transfer assembly is retrievable to the surface of the wellbore prior to cementing. In a further aspect, fluid ports between the interior and exterior of the casing are remotely sealable prior to cementing.

23 Claims, 9 Drawing Sheets

U.S. PATENT DOCUMENTS

| | | | | |
|---|---|---|---|---|
| 2,522,444 | A | 9/1950 | Grable | |
| 2,610,690 | A | 9/1952 | Beatty | |
| 2,621,742 | A | 12/1952 | Brown | |
| 2,627,891 | A | 2/1953 | Clark | |
| 2,641,444 | A | 6/1953 | Moon | |
| 2,650,314 | A | 8/1953 | Hennigh et al. | |
| 2,663,073 | A | 12/1953 | Bieber et al. | |
| 2,668,689 | A | 2/1954 | Cormany | |
| 2,692,059 | A | 10/1954 | Bolling, Jr. | |
| 2,738,011 | A | 3/1956 | Mabry | |
| 2,743,087 | A | 4/1956 | Layne et al. | |
| 2,743,495 | A | 5/1956 | Eklund | |
| 2,764,329 | A | 9/1956 | Hampton | |
| 2,765,146 | A | 10/1956 | Williams | |
| 2,805,043 | A | 9/1957 | Williams | |
| 3,087,546 | A | 4/1963 | Wooley | |
| 3,102,599 | A | 9/1963 | Hillburn | |
| 3,122,811 | A | 3/1964 | Gilreath | |
| 3,123,160 | A | 3/1964 | Kammerer | |
| 3,159,219 | A | 12/1964 | Scott | |
| 3,169,592 | A | 2/1965 | Kammerer | |
| 3,191,677 | A | 6/1965 | Kinley | |
| 3,191,680 | A | 6/1965 | Vincent | |
| 3,353,599 | A | 11/1967 | Swift | |
| 3,380,528 | A | 4/1968 | Timmons | |
| 3,387,893 | A | 6/1968 | Hoever | |
| 3,392,609 | A | 7/1968 | Bartos | |
| 3,489,220 | A | 1/1970 | Kinley | |
| 3,518,903 | A | 7/1970 | Ham et al. | |
| 3,550,684 | A | 12/1970 | Cubberly, Jr. | |
| 3,552,508 | A | 1/1971 | Brown | |
| 3,552,509 | A | 1/1971 | Brown | |
| 3,552,510 | A | 1/1971 | Brown | |
| 3,559,739 | A | 2/1971 | Hutchison | |
| 3,570,598 | A | 3/1971 | Johnson | |
| 3,575,245 | A | 4/1971 | Cordary et al. | |
| 3,603,411 | A | 9/1971 | Link | |
| 3,603,412 | A | 9/1971 | Kammerer, Jr. et al. | |
| 3,603,413 | A | 9/1971 | Grill et al. | |
| 3,624,760 | A | 11/1971 | Bodine | |
| 3,656,564 | A | 4/1972 | Brown | |
| 3,669,190 | A | 6/1972 | Sizer et al. | |
| 3,691,624 | A | 9/1972 | Kinley | |
| 3,692,126 | A | 9/1972 | Rushing et al. | |
| 3,700,048 | A | 10/1972 | Desmoulins | |
| 3,729,057 | A | 4/1973 | Werner | |
| 3,747,675 | A | 7/1973 | Brown | |
| 3,785,193 | A | 1/1974 | Kinley et al. | |
| 3,808,916 | A | 5/1974 | Porter et al. | |
| 3,838,613 | A | 10/1974 | Wilms | |
| 3,840,128 | A | 10/1974 | Swoboda, Jr. et al. | |
| 3,870,114 | A | 3/1975 | Pulk et al. | |
| 3,881,375 | A | 5/1975 | Kelly | |
| 3,885,679 | A | 5/1975 | Swoboda, Jr. et al. | |
| 3,901,331 | A | 8/1975 | Djurovic | |
| 3,934,660 | A | 1/1976 | Nelson | |
| 3,945,444 | A | 3/1976 | Knudson | |
| 3,964,556 | A | 6/1976 | Gearhart et al. | |
| 3,980,143 | A | 9/1976 | Swartz et al. | |
| 4,049,066 | A | 9/1977 | Richey | |
| 4,054,426 | A | 10/1977 | White | |
| 4,063,602 | A | 12/1977 | Howell et al. | 175/7 |
| 4,064,939 | A | 12/1977 | Marquis | |
| 4,077,525 | A | 3/1978 | Callegari et al. | |
| 4,082,144 | A | 4/1978 | Marquis | |
| 4,083,405 | A | 4/1978 | Shirley | |
| 4,085,808 | A | 4/1978 | Kling | |
| 4,100,968 | A | 7/1978 | Delano | |
| 4,100,981 | A | 7/1978 | Chaffin | |
| 4,133,396 | A | 1/1979 | Tschirky | |
| 4,142,739 | A | 3/1979 | Billingsley | |
| 4,173,457 | A | 11/1979 | Smith | |
| 4,175,619 | A | 11/1979 | Davis | |
| 4,186,628 | A | 2/1980 | Bonnice | |
| 4,189,185 | A | 2/1980 | Kammerer, Jr. et al. | |
| 4,221,269 | A | 9/1980 | Hudson | |
| 4,257,442 | A | 3/1981 | Claycomb | |
| 4,262,693 | A | 4/1981 | Giebeler | |
| 4,274,777 | A | 6/1981 | Scaggs | |
| 4,274,778 | A | 6/1981 | Putnam et al. | |
| 4,281,722 | A | 8/1981 | Tucker et al. | |
| 4,287,949 | A | 9/1981 | Lindsey, Jr. | |
| 4,291,772 | A | 9/1981 | Beynet | 175/5 |
| 4,315,553 | A | 2/1982 | Stallings | |
| 4,320,915 | A | 3/1982 | Abbott et al. | |
| 4,336,415 | A | 6/1982 | Walling | |
| 4,384,627 | A | 5/1983 | Ramirez-Jauregui | |
| 4,396,076 | A | 8/1983 | Inoue | |
| 4,396,077 | A | 8/1983 | Radtke | |
| 4,408,669 | A | 10/1983 | Wiredal | |
| 4,413,682 | A | 11/1983 | Callihan et al. | |
| 4,430,892 | A | 2/1984 | Owings | 73/151 |
| 4,440,220 | A | 4/1984 | McArthur | |
| 4,446,745 | A | 5/1984 | Stone et al. | |
| 4,460,053 | A | 7/1984 | Jurgens et al. | |
| 4,463,814 | A | 8/1984 | Horstmeyer et al. | |
| 4,466,498 | A | 8/1984 | Bardwell | |
| 4,470,470 | A | 9/1984 | Takano | |
| 4,472,002 | A | 9/1984 | Beney et al. | |
| 4,474,243 | A | 10/1984 | Gaines | |
| 4,483,399 | A | 11/1984 | Colgate | |
| 4,489,793 | A * | 12/1984 | Boren | 175/71 |
| 4,515,045 | A | 5/1985 | Gnatchenko et al. | |
| 4,534,426 | A | 8/1985 | Hooper | 175/65 |
| 4,544,041 | A | 10/1985 | Rinaldi | |
| 4,545,443 | A | 10/1985 | Wiredal | |
| 4,580,631 | A | 4/1986 | Baugh | |
| 4,583,603 | A | 4/1986 | Dorleans et al. | |
| 4,589,495 | A | 5/1986 | Langer et al. | |
| 4,595,058 | A * | 6/1986 | Nations | 166/285 |
| 4,604,724 | A | 8/1986 | Shaginian et al. | |
| 4,604,818 | A | 8/1986 | Inoue | |
| 4,605,077 | A | 8/1986 | Boyadjieff | |
| 4,620,600 | A | 11/1986 | Persson | |
| 4,630,691 | A | 12/1986 | Hooper | |
| 4,651,837 | A | 3/1987 | Mayfield | |
| 4,652,195 | A | 3/1987 | McArthur | |
| 4,655,286 | A | 4/1987 | Wood | |
| 4,671,358 | A | 6/1987 | Lindsey, Jr. et al. | |
| 4,681,158 | A | 7/1987 | Pennison | |
| 4,686,873 | A | 8/1987 | Lang et al. | |
| 4,699,224 | A | 10/1987 | Burton | |
| 4,725,179 | A | 2/1988 | Woolslayer et al. | |
| 4,735,270 | A | 4/1988 | Fenyvesi | |
| 4,744,426 | A | 5/1988 | Reed | |
| 4,760,882 | A | 8/1988 | Novak | |
| 4,762,187 | A | 8/1988 | Haney | |
| 4,765,416 | A | 8/1988 | Bjerking et al. | |
| 4,813,495 | A | 3/1989 | Leach | |
| 4,825,947 | A * | 5/1989 | Mikolajczyk | 166/241.1 |
| 4,832,552 | A | 5/1989 | Skelly | |
| 4,832,891 | A * | 5/1989 | Kass | 264/101 |
| 4,836,299 | A | 6/1989 | Bodine | |
| 4,842,081 | A | 6/1989 | Parant | |
| 4,843,945 | A | 7/1989 | Dinsdale | |
| 4,848,469 | A | 7/1989 | Baugh et al. | |
| 4,854,386 | A | 8/1989 | Baker et al. | |
| 4,880,058 | A | 11/1989 | Lindsey et al. | |
| 4,904,119 | A | 2/1990 | Legendre et al. | |
| 4,921,386 | A | 5/1990 | McArthur | |
| 4,960,173 | A | 10/1990 | Cognevich et al. | |

4,962,822 A 10/1990 Pascale
4,997,042 A 3/1991 Jordan et al.
5,022,472 A 6/1991 Bailey et al.
5,027,914 A 7/1991 Wilson
5,049,020 A 9/1991 McArthur
5,052,483 A 10/1991 Hudson
5,060,542 A 10/1991 Hauk
5,060,737 A 10/1991 Mohn
5,074,366 A 12/1991 Karlsson et al.
5,082,069 A 1/1992 Seiler et al.
5,096,465 A 3/1992 Chen et al.
5,109,924 A 5/1992 Jurgens et al.
5,111,893 A 5/1992 Kvello-Aune
5,148,875 A 9/1992 Karlsson et al.
5,160,925 A 11/1992 Dailey et al.
5,168,942 A 12/1992 Wydrinski
5,172,765 A 12/1992 Sas-Jaworsky
5,181,571 A * 1/1993 Mueller ..... 166/381
5,186,265 A 2/1993 Henson et al.
5,191,939 A 3/1993 Stokley
5,197,553 A 3/1993 Leturno
5,205,365 A * 4/1993 Quintana ..... 175/97
5,234,052 A 8/1993 Coone et al.
5,255,741 A 10/1993 Alexander
5,255,751 A 10/1993 Stogner
5,271,472 A 12/1993 Leturno
5,282,653 A 2/1994 LaFleur et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al.
5,305,830 A 4/1994 Wittrisch
5,318,122 A 6/1994 Murray et al.
5,320,178 A 6/1994 Cornette
5,322,127 A 6/1994 McNair et al.
5,323,858 A 6/1994 Jones et al.
5,332,048 A 7/1994 Underwood et al.
5,339,899 A 8/1994 Ravi et al. ..... 166/250
5,343,950 A 9/1994 Hale et al.
5,343,951 A 9/1994 Cowan et al.
5,353,872 A 10/1994 Wittrisch
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,402,856 A 4/1995 Warren et al.
5,435,400 A 7/1995 Smith
5,452,923 A 9/1995 Smith
5,456,317 A * 10/1995 Hood, III et al. ..... 166/296
5,458,209 A 10/1995 Hayes et al.
5,472,057 A * 12/1995 Winfree ..... 175/57
5,477,925 A 12/1995 Trahan et al.
5,497,840 A 3/1996 Hudson
5,520,255 A 5/1996 Barr et al.
5,526,880 A 6/1996 Jordan, Jr. et al.
5,535,824 A 7/1996 Hudson
5,535,838 A 7/1996 Keshavan et al.
5,546,317 A 8/1996 Andrieu
5,547,029 A 8/1996 Rubbo et al.
5,551,521 A 9/1996 Vail, III
5,553,679 A 9/1996 Thorp
5,560,437 A 10/1996 Dickel et al.
5,560,440 A 10/1996 Tibbitts
5,575,344 A 11/1996 Wireman
5,582,259 A 12/1996 Barr
5,584,343 A 12/1996 Coone
5,613,567 A 3/1997 Hudson
5,615,747 A 4/1997 Vail, III
5,651,420 A 7/1997 Tibbitts et al.
5,661,888 A 9/1997 Hanslik
5,662,170 A 9/1997 Donovan et al.
5,662,182 A 9/1997 McLeod et al.
5,667,023 A 9/1997 Harrell et al.
5,667,026 A 9/1997 Lorenz et al.
5,706,905 A 1/1998 Barr
5,711,382 A 1/1998 Hansen et al.
5,717,334 A 2/1998 Vail, III et al.
5,720,356 A 2/1998 Gardes
5,732,776 A 3/1998 Tubel et al.
5,735,348 A 4/1998 Hawkins, III
5,743,344 A 4/1998 McLeod et al.
5,746,276 A 5/1998 Stuart
5,785,132 A 7/1998 Richardson et al.
5,785,134 A 7/1998 McLeod et al.
5,787,978 A 8/1998 Carter et al.
5,803,666 A 9/1998 Keller
5,826,651 A 10/1998 Lee et al.
5,828,003 A 10/1998 Thomeer et al.
5,829,520 A 11/1998 Johnson
5,833,002 A 11/1998 Holcombe
5,836,409 A 11/1998 Vail, III
5,839,330 A 11/1998 Stokka
5,839,519 A 11/1998 Spedale, Jr.
5,842,530 A 12/1998 Smith et al.
5,845,722 A 12/1998 Makohl et al.
5,860,474 A 1/1999 Stoltz et al.
5,887,655 A 3/1999 Haugen et al.
5,887,668 A 3/1999 Haugen et al.
5,890,537 A 4/1999 Lavaure et al.
5,890,549 A 4/1999 Sprehe
5,894,897 A 4/1999 Vail, III
5,908,049 A 6/1999 Williams et al.
5,913,337 A 6/1999 Williams et al.
5,921,285 A 7/1999 Quigley et al.
5,921,332 A 7/1999 Spedale, Jr.
5,931,231 A 8/1999 Mock
5,947,213 A 9/1999 Angle et al.
5,950,742 A 9/1999 Caraway
5,957,225 A 9/1999 Sinor
5,971,079 A 10/1999 Mullins
6,000,472 A 12/1999 Albright et al.
6,024,169 A 2/2000 Haugen
6,026,911 A 2/2000 Angle et al.
6,035,953 A 3/2000 Rear
6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,671 A 6/2000 Cumming et al.
6,098,717 A 8/2000 Bailey et al.
6,119,772 A 9/2000 Pruet
6,135,208 A 10/2000 Gano et al.
6,155,360 A 12/2000 McLeod
6,158,531 A 12/2000 Vail, III
6,170,573 B1 1/2001 Brunet et al.
6,172,010 B1 1/2001 Argillier et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,206,112 B1 3/2001 Dickinson, III et al.
6,216,533 B1 4/2001 Woloson et al.
6,220,117 B1 4/2001 Butcher
6,234,257 B1 5/2001 Ciglenec et al.
6,257,333 B1 7/2001 Mann et al.
6,263,987 B1 7/2001 Vail, III

| | | | | |
|---|---|---|---|---|
| 6,296,066 | B1 | 10/2001 | Terry et al. | |
| 6,305,469 | B1 | 10/2001 | Coenen et al. | |
| 6,311,792 | B1 | 11/2001 | Scott et al. | |
| 6,315,051 | B1 | 11/2001 | Ayling | |
| 6,325,148 | B1 | 12/2001 | Trahan et al. | |
| 6,343,649 | B1 | 2/2002 | Beck et al. | |
| 6,357,485 | B2 | 3/2002 | Quigley et al. | |
| 6,359,569 | B2 | 3/2002 | Beck et al. | |
| 6,371,203 | B2 | 4/2002 | Frank et al. | |
| 6,374,924 | B1 | 4/2002 | Hanton et al. | |
| 6,378,627 | B1 | 4/2002 | Tubel et al. | |
| 6,378,630 | B1 | 4/2002 | Ritorto et al. | |
| 6,397,946 | B1 | 6/2002 | Vail, III | |
| 6,405,798 | B1 | 6/2002 | Barrett et al. | |
| 6,408,943 | B1 | 6/2002 | Schultz et al. | |
| 6,412,554 | B1 | 7/2002 | Allen et al. | |
| 6,412,574 | B1 | 7/2002 | Wardley et al. | |
| 6,419,014 | B1 | 7/2002 | Meek et al. | |
| 6,419,033 | B1 | 7/2002 | Hahn et al. | |
| 6,427,776 | B1 | 8/2002 | Hoffman et al. | |
| 6,443,241 | B1 | 9/2002 | Juhasz et al. | |
| 6,443,247 | B1 | 9/2002 | Wardley | |
| 6,457,532 | B1 | 10/2002 | Simpson | |
| 6,464,004 | B1 | 10/2002 | Crawford et al. | |
| 6,484,818 | B2 | 11/2002 | Alft et al. | |
| 6,497,280 | B2 | 12/2002 | Beck et al. | |
| 6,527,047 | B1 | 3/2003 | Pietras | |
| 6,527,064 | B1 | 3/2003 | Hallundbaek | |
| 6,536,520 | B1 | 3/2003 | Snider et al. | |
| 6,536,993 | B2 | 3/2003 | Strong et al. | |
| 6,538,576 | B1 | 3/2003 | Schultz et al. | |
| 6,543,552 | B1 | 4/2003 | Metcalfe et al. | |
| 6,547,017 | B1 | 4/2003 | Vail, III | |
| 6,554,064 | B1 | 4/2003 | Restarick et al. | |
| 6,591,471 | B1 | 7/2003 | Hollingsworth et al. | |
| 6,619,402 | B1 * | 9/2003 | Amory et al. | 166/370 |
| 6,634,430 | B2 * | 10/2003 | Dawson et al. | 166/381 |
| 6,668,937 | B1 * | 12/2003 | Murray | 166/381 |
| 6,702,040 | B1 | 3/2004 | Sensenig | |
| 6,719,071 | B1 | 4/2004 | Moyes | |
| 6,742,606 | B2 | 6/2004 | Metcalfe et al. | |
| 2001/0000101 | A1 | 4/2001 | Lovato et al. | |
| 2001/0002626 | A1 | 6/2001 | Frank et al. | |
| 2001/0013412 | A1 | 8/2001 | Tubel | |
| 2001/0040054 | A1 | 11/2001 | Haugen et al. | |
| 2001/0042625 | A1 | 11/2001 | Appleton | |
| 2001/0047883 | A1 | 12/2001 | Hanton et al. | |
| 2002/0040787 | A1 | 4/2002 | Cook et al. | |
| 2002/0066556 | A1 | 6/2002 | Goode et al. | |
| 2002/0074127 | A1 | 6/2002 | Birckhead et al. | |
| 2002/0074132 | A1 | 6/2002 | Juhasz et al. | |
| 2002/0079102 | A1 | 6/2002 | Dewey et al. | |
| 2002/0134555 | A1 | 9/2002 | Allen et al. | |
| 2002/0157829 | A1 | 10/2002 | Davis et al. | |
| 2002/0162690 | A1 | 11/2002 | Hanton et al. | |
| 2002/0189806 | A1 | 12/2002 | Davidson et al. | |
| 2002/0189863 | A1 | 12/2002 | Wardley | |
| 2003/0034177 | A1 | 2/2003 | Chitwood et al. | |
| 2003/0056991 | A1 | 3/2003 | Hahn et al. | |
| 2003/0070841 | A1 | 4/2003 | Merecka et al. | |
| 2003/0111267 | A1 | 6/2003 | Pia | |
| 2003/0141111 | A1 | 7/2003 | Pia | |
| 2003/0146023 | A1 | 8/2003 | Pia | |
| 2003/0217865 | A1 | 11/2003 | Simpson et al. | |
| 2003/0221519 | A1 | 12/2003 | Haugen et al. | |
| 2004/0003490 | A1 | 1/2004 | Shahin et al. | |
| 2004/0003944 | A1 | 1/2004 | Vincent et al. | |
| 2004/0011534 | A1 | 1/2004 | Simonds et al. | |
| 2004/0031622 | A1 | 2/2004 | Butler et al. | |
| 2004/0069501 | A1 | 4/2004 | Haugen et al. | |
| 2004/0112603 | A1 | 6/2004 | Galloway et al. | |
| 2004/0118614 | A1 | 6/2004 | Galloway et al. | |
| 2004/0124010 | A1 | 7/2004 | Galloway et al. | |
| 2004/0124011 | A1 | 7/2004 | Gledhill et al. | |

FOREIGN PATENT DOCUMENTS

| | | | |
|---|---|---|---|
| EP | 0 554 568 | 8/1993 | |
| EP | 0 571 045 | 8/1998 | E21B/7/06 |
| EP | 0 961 007 | 12/1999 | |
| EP | 1 006 260 | 6/2000 | |
| EP | 1 050 661 | 11/2000 | E21B/7/18 |
| FR | 2053088 | 7/1970 | |
| GB | 540 027 | 10/1941 | |
| GB | 7 928 86 | 4/1958 | |
| GB | 8 388 33 | 6/1960 | |
| GB | 9 977 21 | 7/1965 | |
| GB | 1 277 461 | 6/1972 | |
| GB | 1 306 568 | 2/1973 | |
| GB | 1 448 304 | 9/1976 | |
| GB | 1 469 661 | 4/1977 | |
| GB | 1 582 392 | 1/1981 | |
| GB | 2 053 088 | 2/1981 | |
| GB | 2 201 912 | 9/1988 | |
| GB | 2 216 926 | 10/1989 | |
| GB | 2 313 860 | 2/1997 | |
| GB | 2 320 270 | 6/1998 | |
| GB | 2 324 108 | 10/1998 | |
| GB | 2 333 542 | 7/1999 | |
| GB | 2 335 217 | 9/1999 | |
| GB | 2 348 223 | 9/2000 | |
| GB | 2 357 101 | 6/2001 | E21B/7/06 |
| GB | 2 365 463 | 2/2002 | |
| GB | 2 372 271 | 8/2002 | |
| GB | 2 382 361 | 5/2003 | |
| GB | 2 389 130 | 12/2003 | |
| RU | SU 1618870 | 1/1991 | E21B/33/14 |
| SU | 112631 | 1/1956 | |
| SU | 659260 | 4/1967 | |
| SU | 247162 | 5/1967 | |
| SU | 395557 | 12/1971 | |
| SU | 415346 | 3/1972 | |
| SU | 481689 | 6/1972 | |
| SU | 461218 | 4/1973 | |
| SU | 501139 | 12/1973 | |
| SU | 585266 | 7/1974 | |
| SU | 583278 | 8/1974 | |
| SU | 601390 | 1/1976 | |
| SU | 581238 | 2/1976 | |
| SU | 655843 | 3/1977 | |
| SU | 781312 | 3/1978 | |
| SU | 899820 | 6/1979 | |
| SU | 955765 | 2/1981 | |
| SU | 1304470 | 8/1984 | |
| SU | 1808972 | 5/1991 | |
| WO | WO 90/06418 | 6/1990 | |
| WO | WO 91/16520 | 10/1991 | |
| WO | WO 92/01139 | 1/1992 | |
| WO | WO 92/18743 | 10/1992 | |
| WO | WO 92/20899 | 11/1992 | |
| WO | WO 93/24728 | 12/1993 | |
| WO | WO 95/10686 | 4/1995 | |
| WO | WO 96/28635 | 9/1996 | |
| WO | WO 97/08418 | 3/1997 | E21B/4/18 |
| WO | WO 98/09053 | 3/1998 | |
| WO | WO 98/55730 | 12/1998 | E21B/23/00 |
| WO | WO 99/11902 | 3/1999 | |
| WO | WO 99/23354 | 5/1999 | |
| WO | WO 99/37881 | 7/1999 | |
| WO | WO 99/50528 | 10/1999 | |
| WO | WO 99/64713 | 12/1999 | |
| WO | WO 00/04269 | 1/2000 | E21B/21/08 |
| WO | WO 00/05483 | 2/2000 | E21B/19/16 |

| | | | |
|---|---|---|---|
| WO | WO 00/08293 | 2/2000 | |
| WO | WO 00/11309 | 3/2000 | ..... E21B/19/16 |
| WO | WO 00/11310 | 3/2000 | ..... E21B/19/16 |
| WO | WO 00/11311 | 3/2000 | ..... E21B/19/16 |
| WO | WO 00/28188 | 5/2000 | ..... E21B/7/06 |
| WO | WO 00/37766 | 6/2000 | |
| WO | WO 00/37771 | 6/2000 | ..... E21B/43/10 |
| WO | WO 00/50730 | 8/2000 | ..... E21B/10/66 |
| WO | WO 00/50731 | 8/2000 | ..... E21B/21/00 |
| WO | WO 01/12946 | 2/2001 | ..... E21B/19/00 |
| WO | WO 01/46550 | 6/2001 | ..... E21B/7/20 |
| WO | WO 01/79650 | 10/2001 | ..... E21B/10/60 |
| WO | WO 01/81708 | 11/2001 | ..... E21B/10/32 |
| WO | WO 01/83932 | 11/2001 | |
| WO | WO 01/94738 | 12/2001 | ..... E21B/7/20 |
| WO | WO 01/94739 | 12/2001 | ..... E21B/7/20 |
| WO | WO 02/14649 | 2/2002 | |
| WO | WO 02/086287 | 10/2002 | ..... E21B/47/01 |

OTHER PUBLICATIONS

M.B. Stone and J. Smith, "Expandable Tubulars and Casing Drilling are Options" Drilling Contractor, Jan./Feb. 2002, pp. 52.

M. Gelfgat, "Retractable Bits Development and Application" Transactions of the ASME, vol. 120, Jun. (1998), pp. 124–130.

"First Success with Casing–Drilling" Word Oil, Feb. (1999), pp. 25.

Dean E. Gaddy, Editor, "Russia Shares Technical Know–How with U.S." Oil & Gas Journal, Mar. (1999), pp. 51–52 and 54–56.

U.S. Appl. No. 10/794,800, filed Mar. 5, 2004, (WEAT/0360).

U.S. Appl. No. 10/832,804, filed Apr. 27, 2004, (WEAT/0383.P1).

U.S. Appl. No. 10/795,214, filed Mar. 5, 2004, (WEAT/0373).

U.S. Appl. No. 10/794,795, filed Mar. 5, 2004, (WEAT/0357).

U.S. Appl. No. 10/775,048, filed Feb. 9, 2004, (WEAT/0359).

U.S. Appl. No. 10/772,217, filed Feb. 2, 2004, (WEAT/0344).

U.S. Appl. No. 10/788,976, filed Feb. 27, 2004, (WEAT/0372).

U.S. Appl. No. 10/794,797, filed Mar. 5, 2004, (WEAT/0371).

U.S. Appl. No. 10/767,322, filed Jan. 29, 2004, (WEAT/0343).

U.S. Appl. No. 10/795,129, filed Mar. 5, 2004, (WEAT/0366).

U.S. Appl. No. 10/794,790, filed Mar. 5, 2004, (WEAT/0329).

U.S. Appl. No. 10/162,302, filed Jun. 4, 2004, (WEAT/0410).

Rotary Steerable Technology—Technology Gains Momentum, Oil & Gas Journal, Dec. 28, 1998.

Directional Drilling, M. Mims, World Oil, May 1999, pp. 40–43.

Multilateral Classification System w/Example Applications, Alan MacKenzie & Cliff Hogg, World Oil, Jan. 1999, pp. 55–61.

Tarr, et al., "Casing–while–Drilling: The Next Step Change In Well Construction," World Oil, Oct. 1999, pp. 34–40.

De Leon Mojarro, "Breaking A Paradigm: Drilling With Tubing Gas Wells," SPE Paper 40051, SPE Annual Technical Conference And Exhibition, Mar. 3–5, 1998, pp. 465–472.

De Leon Majarro, "Drilling/Completing With Tubing Cuts Well Costs By 30%," World Oil, Jul. 1998, pp. 145–150.

Littleton, "Refined Slimhole Drilling Technology Renews Operator Interest," Petroleum Engineer International, Jun. 1992, pp. 19–26.

Anon, "Slim Holes Fat Savings," Journal of Petroleum Technology, Sep. 1992, pp. 816–819.

Anon, "Slim Holes, Slimmer Prospect," Journal of Petroleum Technology, Nov. 1995, pp. 949–952.

Vogt, et al., "Drilling Liner Technology For Depleted Reservoir," SPE Paper 36827, SPE Annual Technical Conference And Exhibition, Oct. 22–24, pp. 127–132.

Mojarro, et al., "Drilling/Completing With Tubing Cuts Well Costs By 30%," World Oil, Jul. 1998, pp. 145–150.

Sinor, et al., Rotary Liner Drilling For Depleted Reservoirs, IADC/SPE Paper 39399, IADC/SPE Drilling Conference, Mar. 3–6, 1998, pp 1–13.

Editor, "Innovation Starts At The Top At Tesco," The American Oil & Gas Reporter, Apr., 1998, p. 65.

Tessari, et al., "Casing Drilling—A Revolutionary Approach to Reducing Well Costs," SPE/IADC Paper 52789, SPE/IADC Drilling Conference, Mar. 9–11, 1999, pp. 221–229.

Silverman, "Novel Drilling Method—Casing Drilling Process Eliminates Tripping String," Petroleum Enginner International, Mar. 1999, p. 15.

Silverman, "Drilling Technology—Retractable Bit Eliminates Drill String Trips," Petroleum Engineer International, Apr. 1999, p. 15.

Laurent, et al., "A New Generation Drilling Rig: Hydraulically Powered And Computer Controlled," CADE/CAODC Paper 99–120, CADE/CAODC Spring Drilling Conference, Apr. 7 & 8, 1999, 14 pages.

Madell, et al., "Casing Drilling An Innovative Approach To Reducing Drilling Costs," CADE/CAODC Paper 99–121, CADE/CAODC Spring Drilling Conference, Apr. 7 & 8, 1999, pp. 1–12.

Tessari, et al., "Focus: Drilling With Casing Promises Major Benefits," Oil & Gas Journal, May 17, 1999, pp. 58–62.

Laurent, et al., "Hydraulic Rig Supports Casing Drilling, " World Oil, Sep. 1999, pp. 61–68.

Perdue, et al., "Casing Technology Improves," Hart's E & P, Nov. 1999, pp. 135–136.

Warren, et al., "Casing Drilling Application Design Consideratins," IADC/SPE Paper 59179, IADC/SPE Drilling Conference, Feb. 23–25, 2000 pp 1–11.

Warren, et al., "Drilling Technology: Part I—Casing Drilling With Directional Steering In The U.S. Gulf Of Mexico," Offshore, Jan. 2001, pp. 50–52.

Warren, et al., "Drilling Technology: Part II—Casing Drilling With Directional Steering in The Gulf Of Mexico," Offshore, Feb. 2001, pp. 40–42.

Shepard, et al., "Casing Drilling: An Emerging Technology," IADC/SPE Paper 67731, SPE/IADC Drilling Conference, Feb. 27–Mar. 1, 2001, pp. 1–13.

Editor, "Tesco Finishes Field Trial Program," Drilling Contractor, Mar./Apr. 2001, p. 53.

Warren, et al., "Casing Drilling Technology Moves To More Challenging Application," AADE Paper 01–NC–HO–32, AADE National Drilling Conference, Mar. 27–29, 2001, pp. 1–10.

Shephard, et al., "Casing Drilling: An Emerging Technology," SPE Drilling & Completion, Mar. 2002, pp. 4–14.
Shephard, et al., "Casing Drilling Successfully Applied In Southern Wyoming," World Oil, Jun. 2002, pp. 33–41.
Forest, et al., "Subsea Equipment For Deep Water Drilling Usin Dual Gradient Mud System," SPE/IADC Drilling Conference, Amsterdam, The Netherlands, Feb. 27, 2001–Mar. 01, 2001, 8 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3–6, 1999, pp. 1–16.
Coronado, et al., "Development Of A One–Trip ECP Cement Inflation And Stage Cementing System For Open Hole Completions," IADC/SPE Paper 39345, IADC/SPE Drilling Conference, Mar. 3–6, 1998, pp. 473–481.
Coronado, et al., "A One–Trip External–Casing–Packer Cement–Inflation And Stage–Cementing System," Journal Of Petroleum Technology, Aug. 1998, pp. 76–77.
Quigley, "Coiled Tubing And Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE/IADC Drilling Conference, Mar. 9–11, 1999, 8 pages.
Marker, et al. "Anaconda: Joint Development Project Leads To Digitally Controlled Composite Coiled Tubing Drilling System," SPE paper 60750, SPE/ICOTA Coiled Tubing Roundtable, Apr. 5–6, 2000, pp 1–9.
Cales, et al., Subsidence Remediation—Extending Well Life Through The Use Of Solid Expandable Casing Systems, AADE Paper 01–NC–HO–24, American Association Of Drilling Engineers, Mar. 2001 Conference, pp. 1–16.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10–12, 2002, pp. 1–7.
Sander, et al., "Project Management And Technology Provide Enhanced Performance For Shallow Horizontal Wells," IADC/SPE Paper 74466, IADC/SPE Drilling Conference, Feb. 26–28, 2002, pp. 1–9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26–28, 2002, pp 1–7.
Galloway, "Rotary Drilling With Casing—A Field Proven Method Of Reducing Wellbore Construction Cost," Paper WOCD–0306092, World Oil Casing Drilling Technical Conference, Mar. 6–7, 2003, pp. 1–7.
Fontenot, et al., "New Rig Design Enhances Casing Drilling Operations In Lobo Trend," paper WOCD–0306–04, World Oil Casing Drilling Technical Conference, Mar. 6–7, 2003, pp. 1–13.
McKay, et al., "New Developments In The Technology Of Drilling With Casing: Utilizing A Displaceable DrillShoe Tool," Paper WOCD–0306–05, World Oil Casing Drilling Technical Conference, Mar. 6–7, 2003, pp. 1–11.
Sutriono—Santos, et al., "Drilling With Casing Advances To Floating Drilling Unit With Surface BOP Employed," Paper WOCD–0307–01, World Oil Casing Drilling Technical Conference, Mar. 6–7, 2003, pp. 1–7.
Vincent, et al., "Liner And Casing Drilling—Case Histories And Technology," Paper WOCD–0307–02, World Oil Casing Drilling Technical Conference, Mar. 6–7, 2003, pp. 1–20.
Maute, "Electrical Logging: State–of–the Art," The Log Analyst, May–Jun. 1992, pp. 206–207.
Tessari, et al., "Retrievable Tools Provide Flexibility for Casing Drilling," Paper No. WOCD–0306–01, World Oil Casing Drilling Technical Conference, 2003, pp. 1–11.
Evans, et al., "Development And Testing Of An Economical Casing Connection For Use In Drilling Operations," paper WOCD–0306–03, World Oil Casing Drilling Technical Conference, Mar. 6–7, 2003, pp. 1–10.
Forrest, et al., "Subsea Equipment for Deep Water Drilling Using Dual Gradient Mud System," SPE/IADC Drilling Conference, Amsterdam, The Netherlands, Feb. 27, 2001–Mar. 1, 2001, 8 Pages.
U.S. Appl. No. 09/976,845, filed Oct. 12, 2001.
U.S. Appl. No. 10/156,722, filed May 28, 2002.
PCT Search Report, Application No. GB 0323983.7, dated Dec. 19, 2003.
U.S. Appl. No. 10/189,570, filed Jul. 6, 2002.*
U.S. Appl. No. 10/618,093, filed Jul. 11, 2003.*

* cited by examiner

APPARATUS AND METHODS FOR DRILLING WITH CASING

BACKGROUND OF THE INVENTION

1. Field of the Invention

The present invention relates to the reduction of equivalent circulation density (ECD) in a wellbore. More particularly, the invention relates to the reduction of ECD in a wellbore that is formed while inserting a tubular string that will remain in place in the wellbore as a liner or a casing string. More particularly still, the invention relates to an apparatus and methods to reduce ECD in a wellbore as it is drilled with casing.

2. Description of the Related Art

In the formation of oil and gas wells a borehole is formed in the earth with a drill bit typically mounted at the end of a string of relatively small diameter tubing or drill string. To facilitate the drilling, fluid is circulated through the drill string, out the bit and upward in an annular area between the drill string and the wall of the borehole. The fluid cools the bit and helps remove cuttings. After a predetermined length of borehole is formed, the bit and drill string are removed from the well and larger diameter string called casing or liner is inserted to form the wellbore. The casing is used to line the borehole walls and the annular area between the outer surface of the casing and the borehole is filled with cement to help strengthen the wellbore and aid in isolating sections of the wellbore for hydrocarbon production. In this specification, the terms "borehole" and "wellbore" are used interchangeably and the terms "casing" and "liner" are used interchangeably and relate to a tubular string used to line the walls of a borehole.

The length of borehole formed before it is lined with casing depends largely on pressure developed towards the lower end of the borehole as it is drilled. Because the wellbore is filled with fluid while drilling, a hydrostatic head of pressure is always present and increases with the increased depth of the borehole. Adding to the hydrostatic head is a friction head created by the circulation of the fluid. The combination of hydrostatic and friction heads produces the equivalent circulation density of the fluid. The pressure created by ECD is useful while drilling because it can exceed the pore pressure of formations intersected by the borehole and prevent hydrocarbons from entering the wellbore. However, increased depth of a section of borehole can cause the ECD to exceed a fracture pressure of the formations, forcing the wellbore fluid into the formations and hampering the flow of hydrocarbons into the wellbore after the well is completed. In wells that are drilled in an underbalanced condition, ECD can cause the pressure in the borehole to exceed the pore pressure of the wellbore, making the well over-balanced.

In order to reduce the pressure created by ECD and to increase the length of borehole that can be formed before running in with casing, ECD reduction devices have been used which are designed to be run on drill string and reduce the ECD by adding energy to drilling fluid in the annulus between the drill string and the borehole. Examples include devices that redirect some of the fluid from the drill string out into the annulus and others that have some type of pumping means to add energy to the returning fluid in the annulus. In each instance, the goal is to reduce the effective pressure of the fluid near the bottom of the borehole so that a section of borehole drilled without stopping to run casing can be maximized. An ECD reduction tool and methods for its use is described in co-pending U.S. application Ser. No. 10/156,722 and that specification, filed May 28, 2002 is incorporated herein in its entirety. Additional examples of ECD tools are discussed in Publication No. PCT/GB00/00642 and that publication is also incorporated herein by reference it its entirety.

Drilling with casing is a method of forming a borehole with a drill bit attached to the same string of tubulars that will line the borehole. In other words, rather than run a drill bit on smaller diameter drill string, the bit is run at the end of larger diameter tubing or casing that will remain in the wellbore and be cemented therein. The advantages of drilling with casing are obvious. Because the same string of tubulars transports the bit as lines the borehole, no separate trip into the wellbore is necessary between the forming of the borehole and the lining of the borehole. Drilling with casing is especially useful in certain situations where an operator wants to drill and line a borehole as quickly as possible to minimize the time the borehole remains unlined and subject to collapse or the effects of pressure anomalies. For example, when forming a sub-sea borehole, the initial length of borehole extending from the ocean floor is much more subject to cave in or collapse as the subsequent sections of borehole. Sections of a borehole that intersect areas of high pressure can lead to damage of the borehole between the time the borehole is formed and when it is lined. An area of exceptionally low pressure will drain expensive drilling fluid from the wellbore between the time it is intersected and when the borehole is lined. In each of these instances, the problems can be eliminated or their effects reduced by drilling with casing. Various methods and apparatus for drilling with casing are disclosed in co-pending application Ser. No. 09/848,900 filed May 4, 2001 and that specification is incorporated herein in its entirety.

The challenges and problems associated with drilling with casing are as obvious as the advantages. For example, the string of casing must fit within any preexisting casing already in the wellbore. Because a string of casing transporting the drill bit is left to line the borehole, there is no opportunity to retrieve the bit in the conventional manner. Drill bits made of drillable material, two-piece drill bits and bits integrally formed at the end of casing string have been used to overcome the problems. For example, a two-piece bit has an outer portion with a diameter exceeding the diameter of the casing string. When the borehole is formed, the outer portion is disconnected from an inner portion that can be retrieved to the surface of the well. Typically, a mud motor is used near the end of the liner string to rotate the bit as the connection between the pieces of casing are not designed to withstand the tortuous forces associated with rotary drilling. In this manner, the casing string can be rotated at a moderate speed at the surface as it is inserted and the bit rotates at a much faster speed due to the fluid-powered mud motor.

Equivalent circulating density is as big a factor when drilling with casing as when drilling with conventional drill string because fluid must still be circulated while the borehole is being formed. Because the diameter of the casing is so near the internal diameter of the borehole, conventional ECD reduction techniques are problematic. For example, using a fluid powered pump to add energy to the returning fluid in the annulus between the casing and the borehole is more challenging because there is so little space in the annulus for the blades of a pump. More problematic, any fluid pump/impeller device must operate in the interior of the casing string and the interior of the casing string must be left free of obstruction prior to cementing. Additionally, redirecting fluid from the interior to the exterior of the casing to reduce ECD necessarily requires a fluid path between the interior and exterior of the casing. However, the casing string, to be properly cemented in place must be free of fluid paths between its interior and exterior.

There is a need therefore for a method and apparatus that permits drilling with casing while reducing ECD developed during the drilling process. There is a further need for a method and an apparatus of drilling with casing that leaves the interior of the casing free of obstruction after the borehole is formed. There is yet a further need for a method and apparatus that leaves the walls of the casing ready for cementing after the borehole is formed.

SUMMARY OF THE INVENTION

The present invention provides an apparatus and methods to reduce ECD and pressure associated therewith while drilling with casing. In one aspect, the invention provides an energy transfer assembly locatable at a predetermined location in a casing string. The assembly includes an impeller portion in the interior of the casing to be acted upon by the downward moving fluid in the casing and a pump portion disposed outwardly of the impeller portion and arranged in fluid communication with the upward moving fluid in the annulus between the casing and the borehole, adding energy thereto and reducing pressure therebelow. In another aspect, the energy transfer assembly is retrievable to the surface of the wellbore prior to cementing. In a further aspect, fluid ports between the interior and exterior of the casing are remotely sealable prior to cementing.

DETAILED DESCRIPTION OF THE PREFERRED EMBODIMENT

Figure 1:
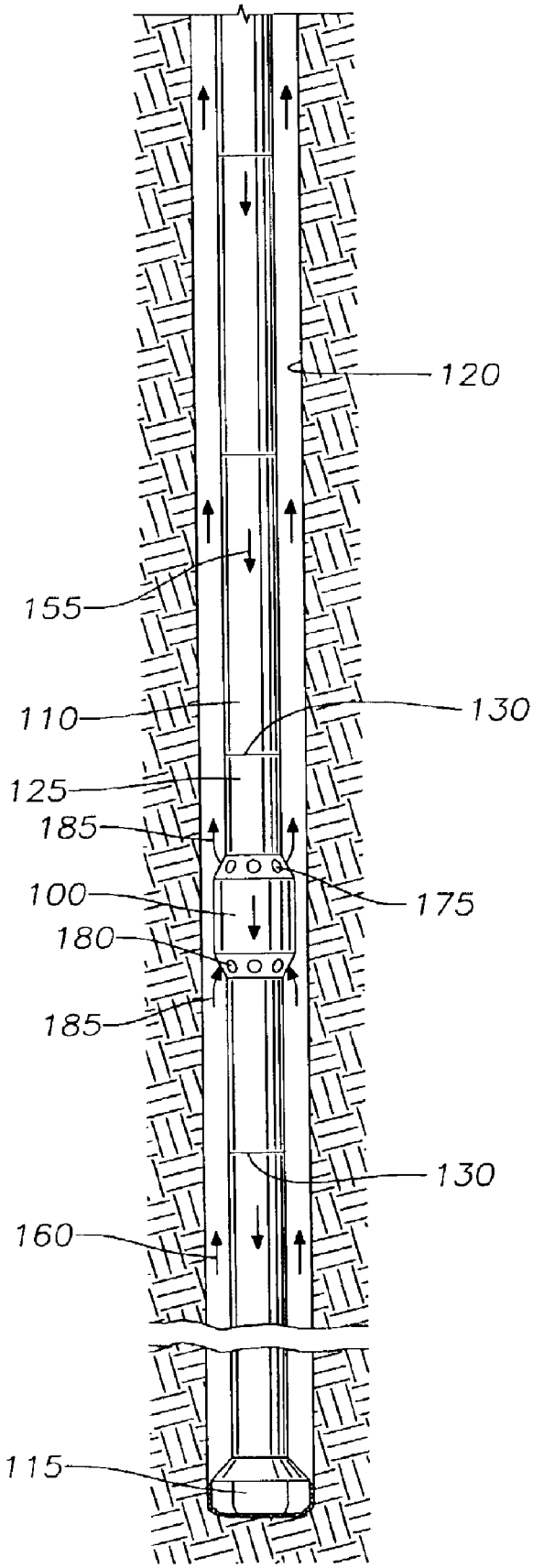
FIG. 1 is a partial section view of a section of casing in a wellbore, the casing having an energy transfer assembly of the present invention disposed therein.

FIG. 1 is a partial section view showing an energy transfer assembly 100 of the present invention disposed in a casing string 110 that is used to transport a drill bit 115 and form a borehole 120. As illustrated, the assembly 100 is typically housed in a sub 125 or separate section of the casing that can be inserted between standard pieces of casing as the casing is run into the well. There are typically threaded connection means 130 at each end of the sub to facilitate connections of the casing. In FIG. 1, the assembly 100 is illustrated at some position in the casing string above the drill bit. In fact, the assembly can be placed at any location in the string depending upon the needs of an operator and multiple assemblies 100 can also be spaced along the string. Illustrated by arrows 155, fluid is pumped downwards through the casing as the borehole is formed and is circulated back to the surface of the well in an annulus as shown by arrows 185. As will be explored in further detail, the energy transfer assembly is operated by the fluid 155 flowing downwards in the casing 110.

Figure 2A:
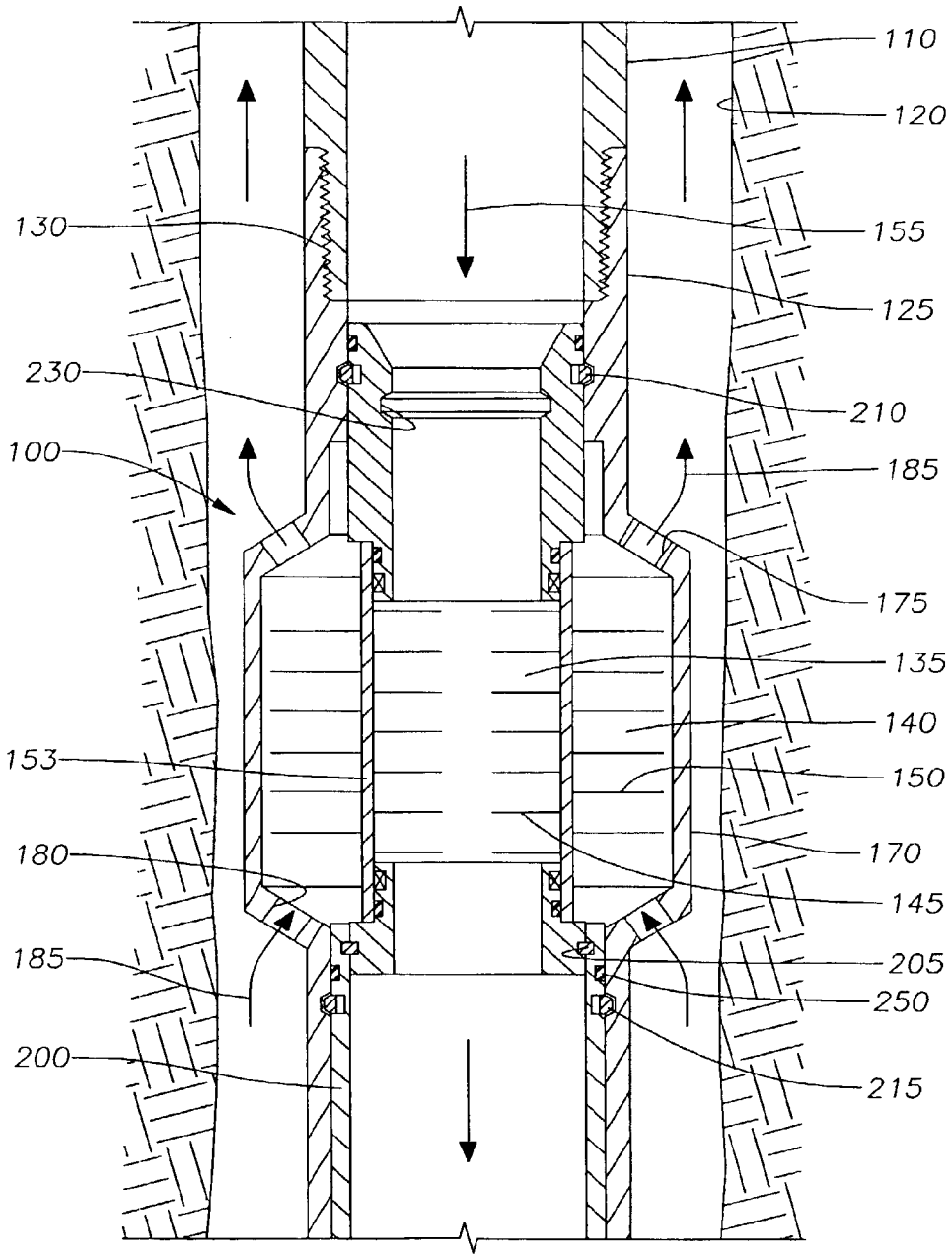
FIGS. 2A and 2B are enlarged views of the energy transfer assembly and its operation.
Figure 2B:
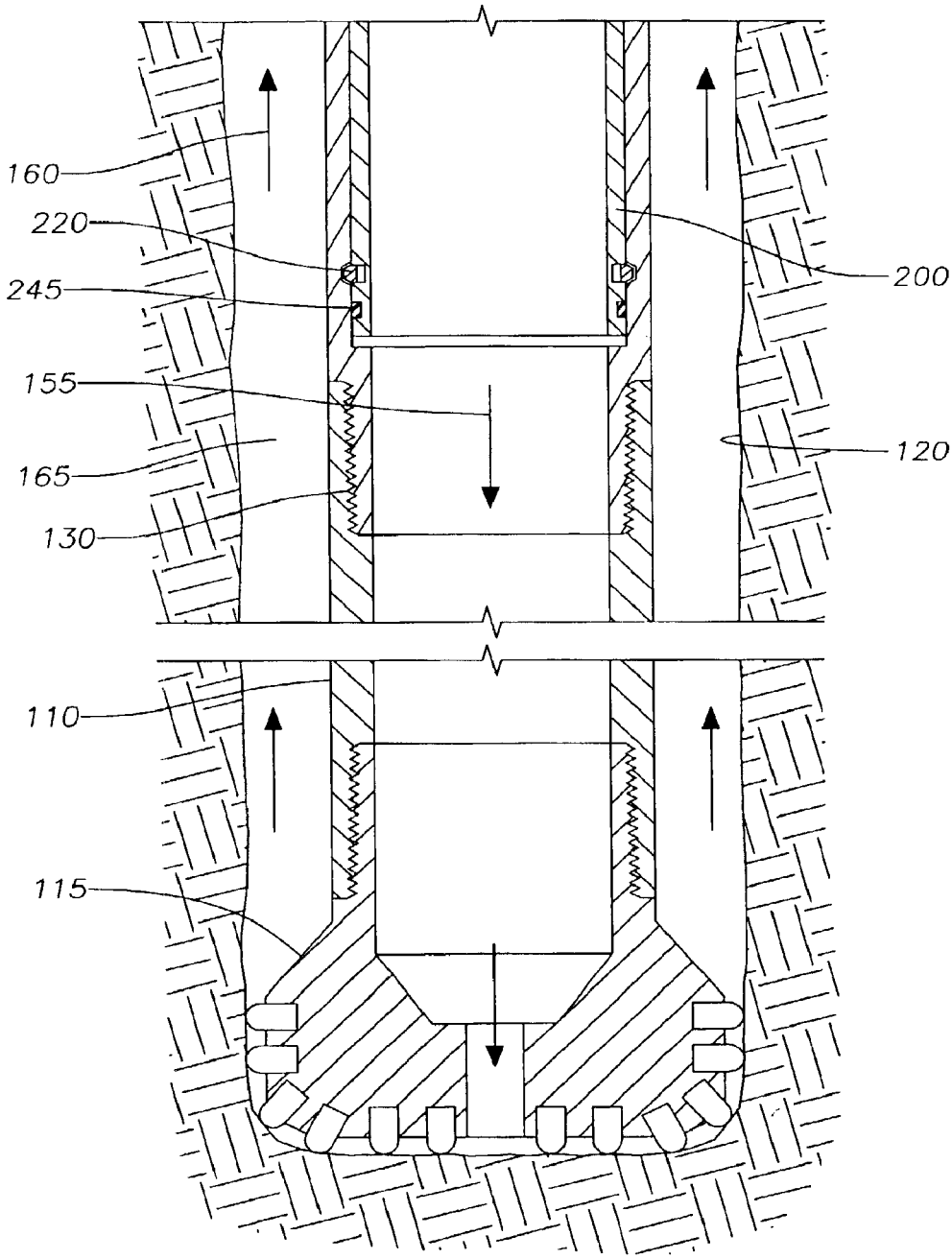

FIG. 2 is a section view showing the energy transfer assembly 100 in greater detail. In one embodiment, the device includes an annular impeller portion 135 and an annular pump portion 140. The impeller portion includes a number of inwardly facing donut-shaped impeller blades 145 that are constructed and arranged to be acted upon by fluid as it travels downward through the casing during drilling. More specifically, the impeller blades are caused to rotate as the fluid moves from one to the next. The principle of the impeller and its use to generate a force is well known to those skilled in the art. Disposed outwards of the impeller portion 135 are a similar number of pumping blades 150. The impeller and pump blades are isolated from each other by body member 153. The pumping blades are designed to rotate with the force created by downwardly flowing fluid 155 upon the impeller blades and to add that force or energy to fluid passing upwards 160 in the annulus 165 of the wellbore. In this manner, ECD or pressure upon the walls of the borehole is reduced near and below the energy transfer device 100.

In addition to protecting an adjacent formation from fracture due to ECD forces, the energy transfer device is also useful to facilitate the insertion of a casing string by reducing the effects of frictional forces encountered as the relatively large diameter casing moves through the newly created borehole.

As shown in FIG. 2, the assembly 100 includes an annularly shaped pocket 170 extending outward from the center of the body to the assembly in the area of the impeller and pump blades. The pocket 170 generally houses the pumping blades 150. At upper and lower ends of the pocket are ports 175, 180 permitting fluid to pass into and out of the energy transfer assembly as illustrated by the arrows 185. In a preferred embodiment, the assembly is designed whereby the pump urges fluid into the lower port 180 and the fluid is then expelled with added energy through the upper port 175. Both the impeller and pump blades can be sized and numbered to create a desired effect according to well conditions and needs of an operator. The ports may also be distributed circumferentially around the upper and lower ends of the pocket 170 to determine the amount of wellbore fluid entering the device from the annulus 165. Also visible in FIG. 2 is a sleeve 200 attached to a lower end of the impeller/pump portion by a shearable member 205. The sleeve permits the ports 175, 180 in the pocket to be sealed prior to cementing as will be explained herein.

FIG. 2 also illustrates aspects of the assembly 100 that permit its retrievability prior to cementing of the casing in the borehole. The assembly is shown in the run-in position with the annular impeller 135 and pump 140 portions disposed in the interior of the sub 125 adjacent the pocket 170. The assembly is held in position by a latch 210 at an upper end that fits within a profile formed in the interior of the sub housing 125. Another latch arrangement 215 exists between an upper end of the sleeve 200 and the interior wall of the sub and a third latch 220 arrangement retains the sleeve 200 at a lower end thereof. In the run-in and operating positions, the latches retain the assembly in the housing as shown in FIG. 2. After the drilling is complete and the casing is ready to be submitted in the wellbore, the assembly 100 may be retrieved from the wellbore by using well-known techniques and tools that are insertable into the wellbore and matable with an inwardly extending profile 230 formed in an upper end of the assembly 100.

In order to retrieve the assembly 100, a removal tool (not shown) with a mating profile to the profile 230 formed at the upper end of the assembly is run into the well and latched to the assembly. Upon the application of a predetermined upward force, the three latches 210, 215, 220 are overcome and the assembly moves upward to the position shown in FIG. 3. Specifically, the second latch 215 assumes the position within the first profile and the third latch assumes a position within the second profile. In this position, the sleeve 200 covers the pocket 170 and seal members 245, 250 at an upper and lower end of the sleeve 200 provide a pressure-tight seal between the sleeve and the body of the sub 125. The pump blades 150 are preferably formed of some stiff but flexible material permitting them to fold downwards as they encounter the wall of the housing as the assembly moves upwards in the sub 125.

Figure 3:
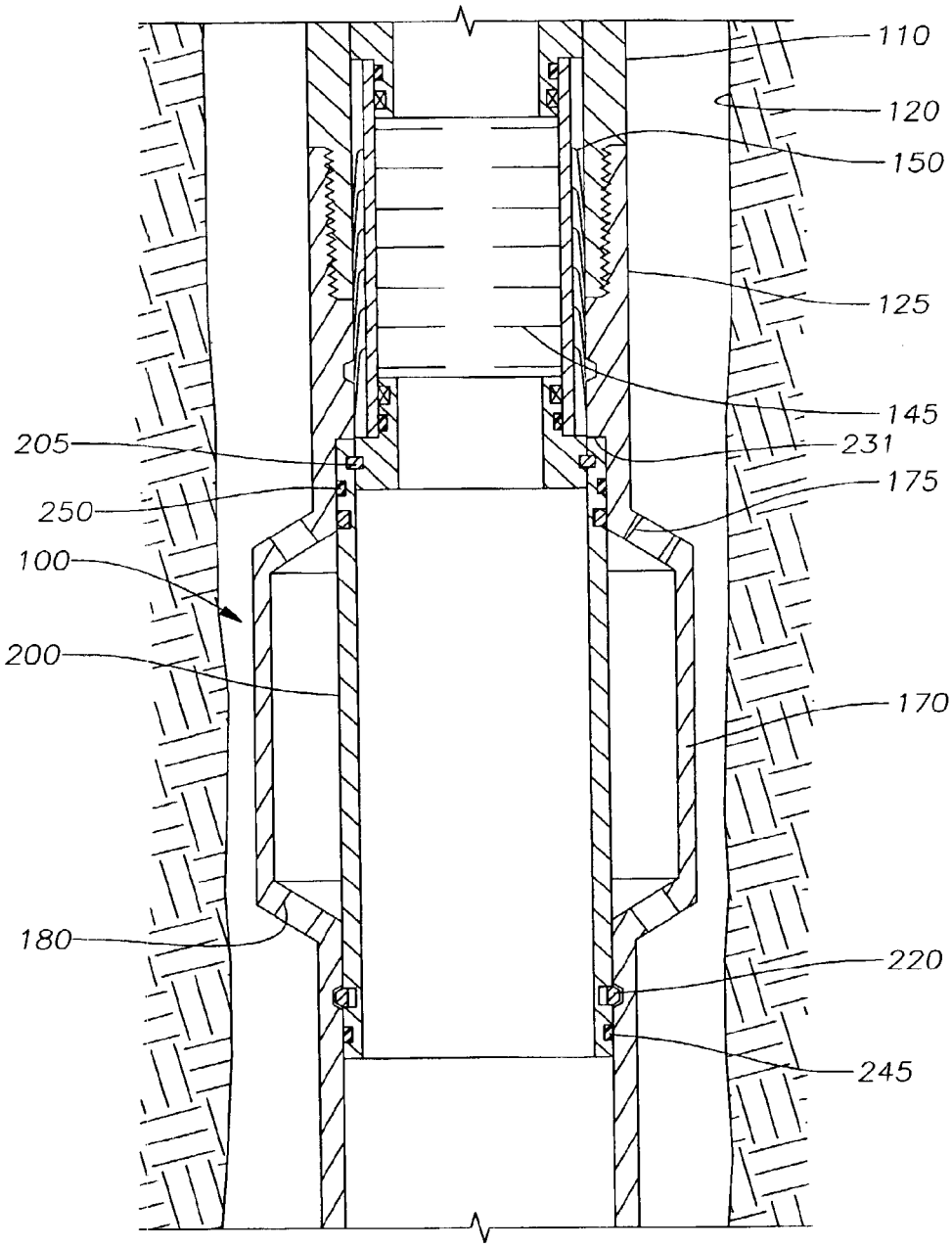
FIG. 3 is a section view of the assembly as it is being retrieved to the surface of the well.

FIG. 3 is a section view showing the assembly 100 after it has been partially removed from the well. FIG. 3 illustrates the sleeve 200 in a position whereby it seals ports 180, 175. In order to complete the retrieval, the shearable connection 205 between the sleeve 200 and the impeller/pump portion is caused to fail by force applied thereto. Preferably, the sleeve "shoulders out" as illustrated at its upper end into a shoulder 231 formed in the interior of the sub 125. In this manner, the sleeve can remain in the interior of the sub without substantially reducing the inside diameter of the casing.

Figure 4:
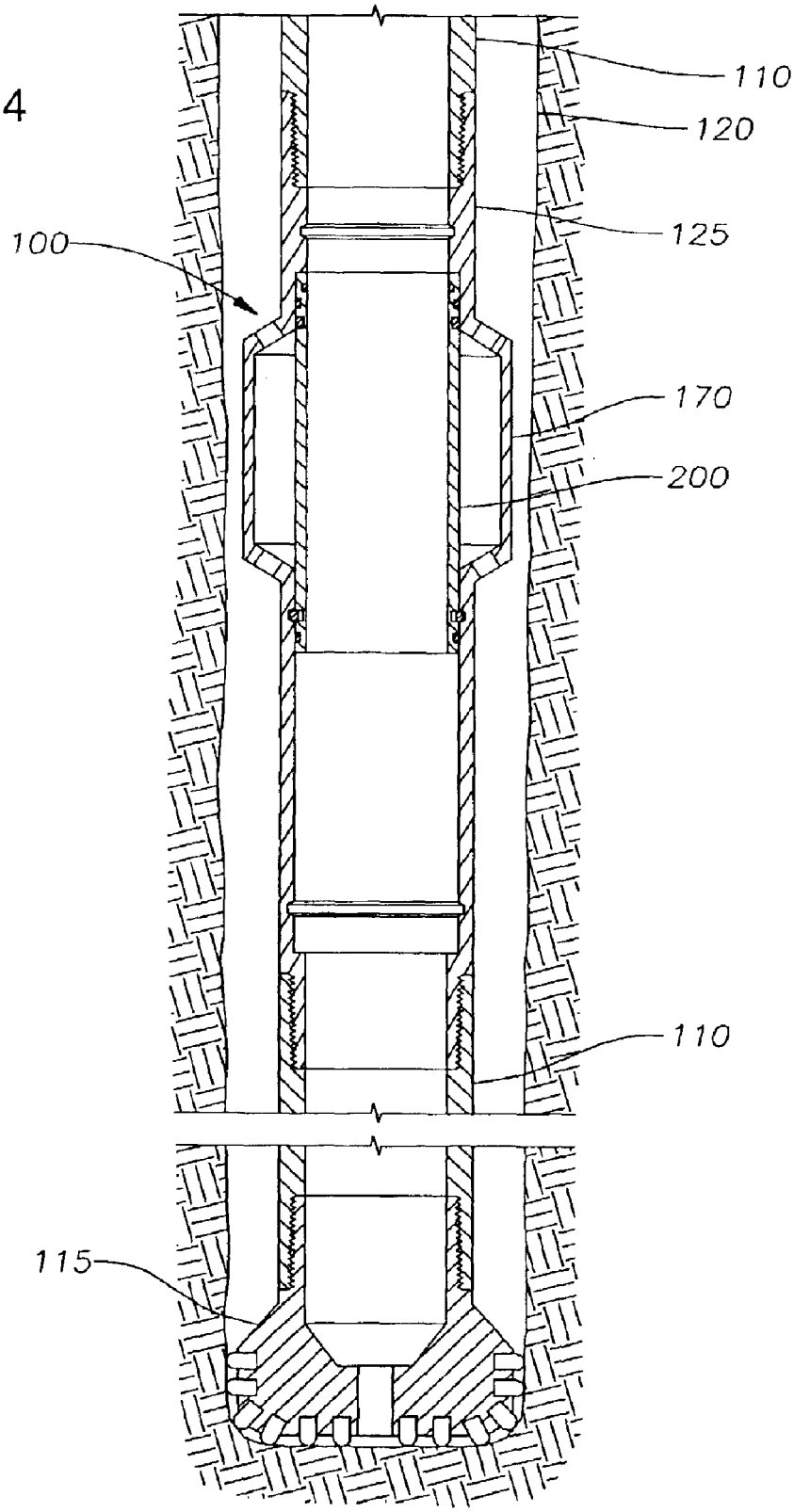
FIG. 4 is a section view showing a sleeve disposed across fluid ports in the casing prior to cementing.
Figure 5A:
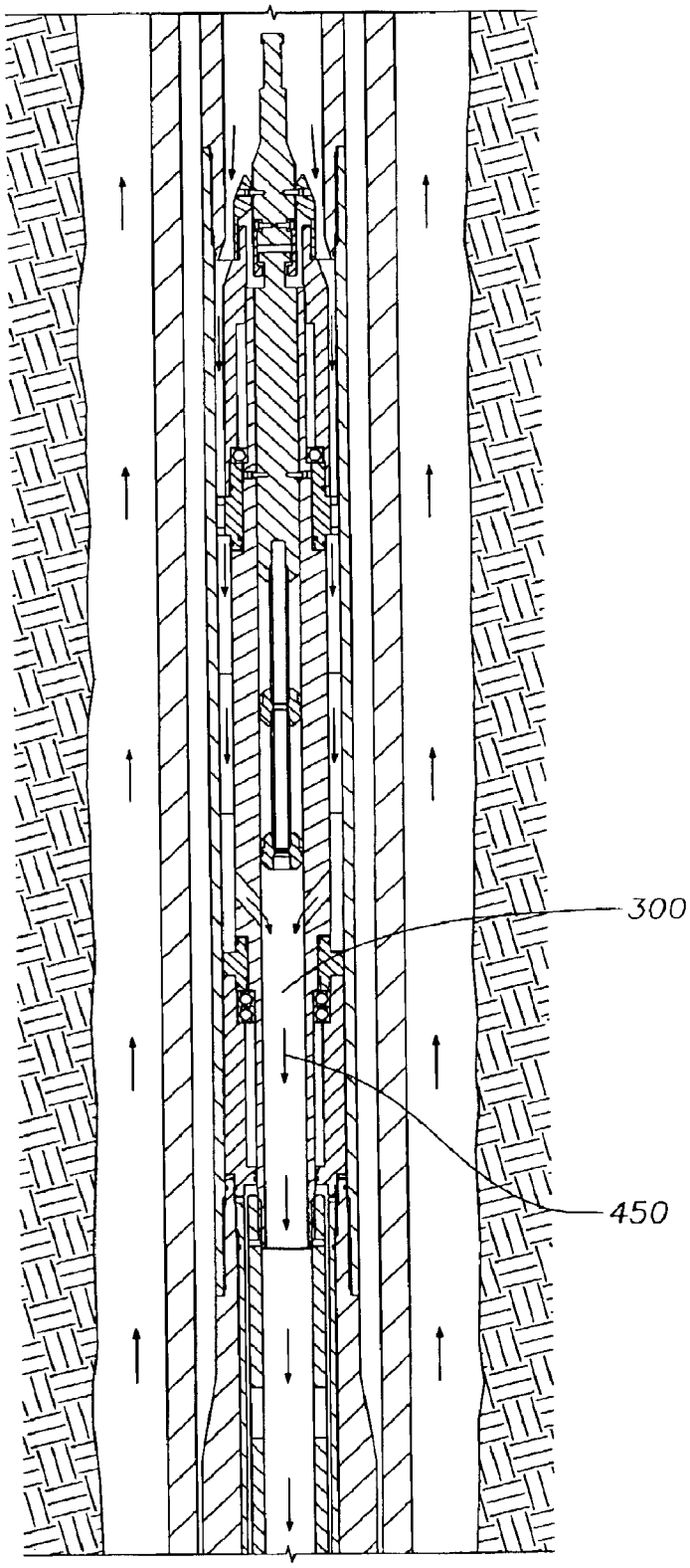
FIGS. 5A–5D are a section view of an alternative embodiment of the invention including a pump and motor housed in a casing string and removable therefrom.
Figure 5B:
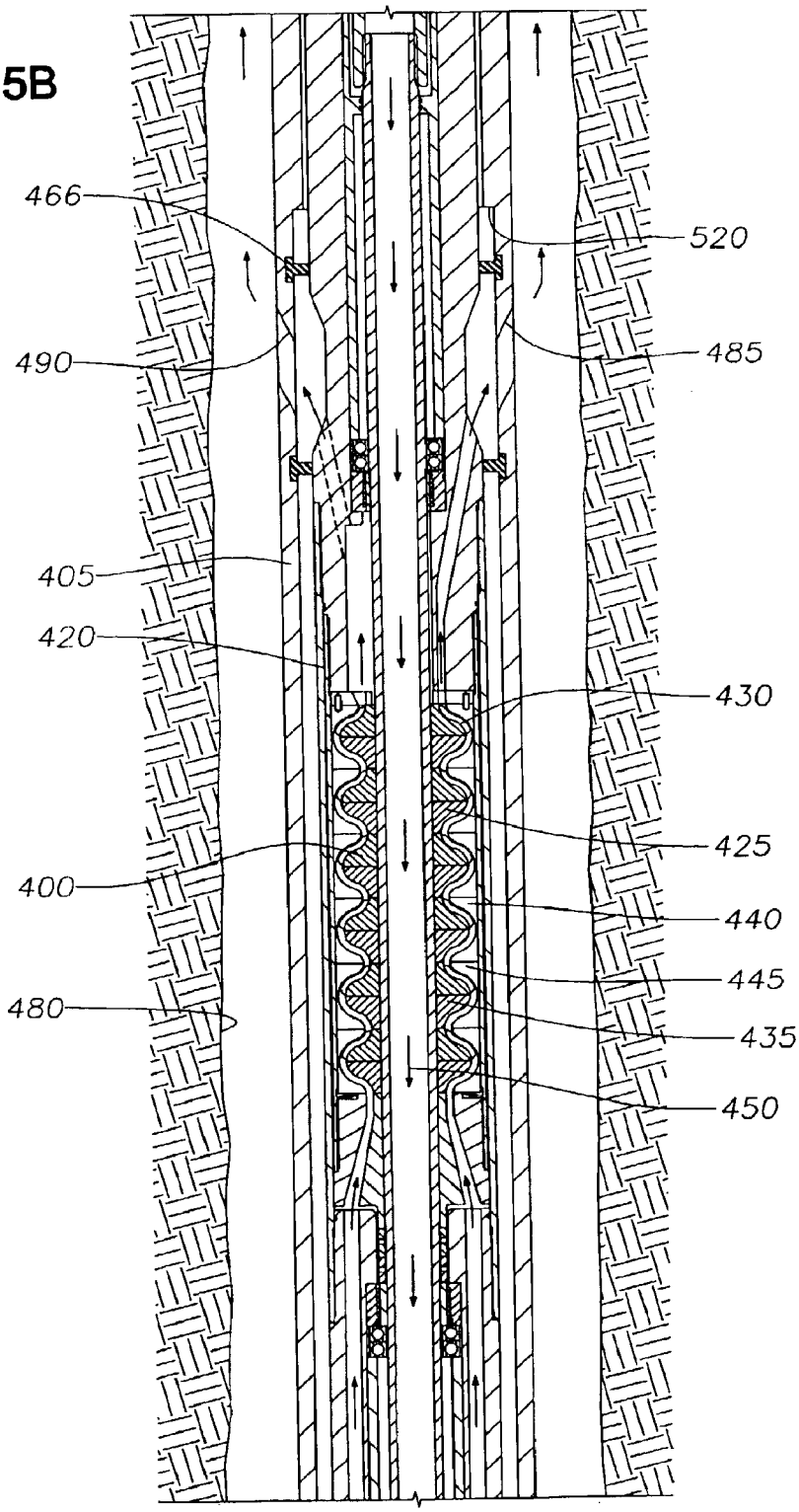
Figure 5C:
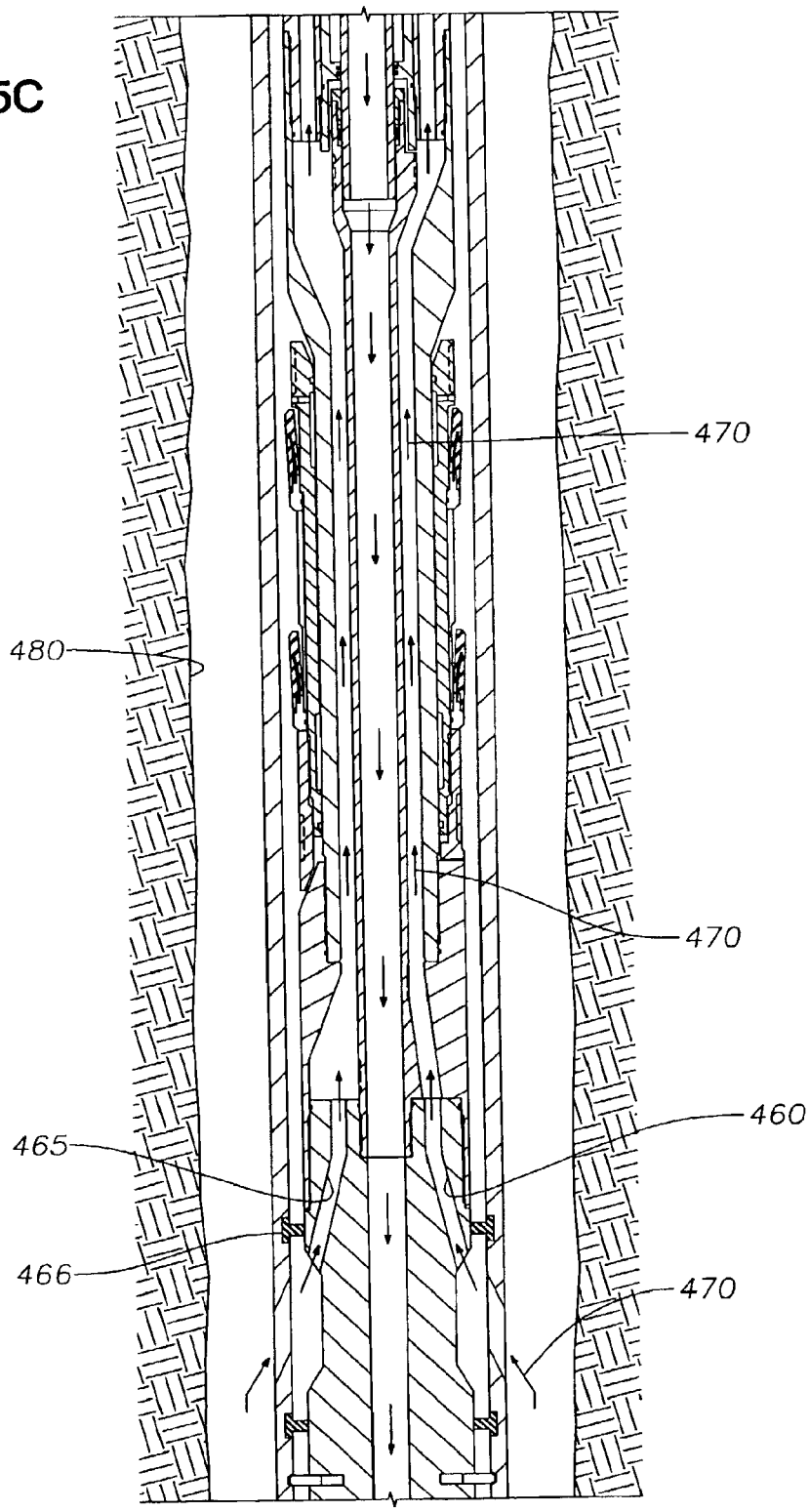
Figure 5D:
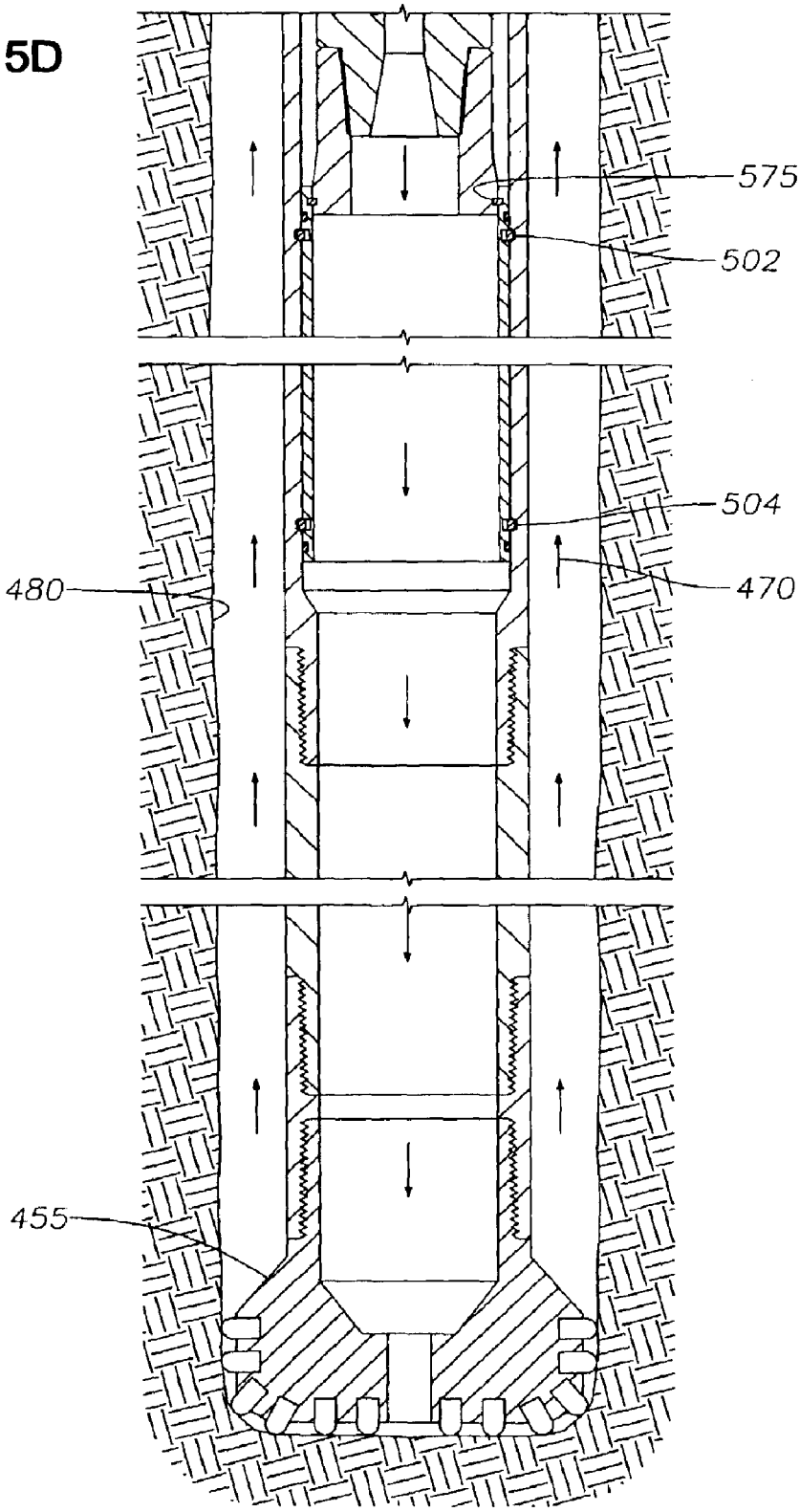

FIG. 4 is a section view showing the impeller/pump portion completely removed and the sleeve remaining in the interior of the sub. With the impeller/pump portion of the assembly retrieved to the surface of the well and the sleeve covering the pocket and preventing fluid communication between the exterior and interior of the casing, the casing may be cemented in the wellbore in a conventional manner.

In another aspect, the invention can be used in a manner that provides selective use of the energy transfer assembly 100 at any time while drilling with casing. For example, the sub with its annular pocket 170 can be provided in a casing string along with a sleeve, which in the run-in position, isolates the interior of the casing from the fluid in the annulus. At some predetermined time, the energy transfer assembly including the impeller and pump blades can be run into the wellbore and landed in the sub in a manner in which its installation shifts the sleeve to a lower position, thereby providing fluid communication between the annulus and the pump blades via the ports 175, 180. In this instance, the energy transfer assembly can be operated at some pre-selected time and later removed from the wellbore. For example if, during the drilling of a borehole with casing, a thief zone is encountered where wellbore fluid is being lost to a formation adjacent the borehole, the energy transfer assembly can be installed in the wellbore and operated to add energy to fluid in the annulus and reduce the tendency of the fluid to flow into an adjacent formation. This alternative arrangement and others are within the purview of this invention.

In another specific embodiment, a pump and motor are each disposed completely within the casing and are removable therefrom. FIGS. 5A, 5B, 5C and 5D are section views of a motor 300 and a pump 400 disposed in a housing that is run in a string of casing. The motor 300 is of the type disclosed in Publication No. PCT/GB99/02450 incorporated by reference herein in its entirety, with fluid directed inwards with nozzles to contact bucket-shaped members and cause a rotor portion of a shaft to turn. The pump 400 disposed in the casing below the motor, includes an impeller section 425 that has outwardly formed undulations 430 formed on an outer surface of a rotor portion 435 of the pump shaft and mating, inwardly formed undulations 440 on an interior of a stator portion 445 of the pump housing 420 therearound.

The motor and pump assembly of FIGS. 5A–5D is constructed and arranged to be entirely housed within the string of casing 405 and is typically disposed in the casing string in a separate sub 405 which is connected in the string. The sub includes a fluid a path for fluid through the assembly towards the drill bit formed at the lower end of the casing string. The path of the fluid is shown with arrows 450 as it travels through the motor 300 and down to the bit 455. Return fluid from the annulus is directed into the assembly through ports 460, 465 provided at a lower end thereof. After entering the ports, the fluid travels in annular fashion where it is acted upon by the pump portion and energy is added thereto. The path of the return fluid is shown by arrows 470. After leaving the pump, the fluid travels back into the annulus defined between the borehole 480 and the casing string. Another pair of ports 485, 490 provides a path for the returning fluid. The ports 460, 465, 485, 490 are sealed with bridge type seals 466 at an upper and lower ends thereof.

The assembly of FIGS. 5A–5D is also completely removable and includes an upper 502 and lower 504 latch assemblies that are disengageable with the application of an upwards force as described in previous embodiments. Additionally, like previously described embodiments, the assembly includes a sleeve member 510 constructed and arranged to remain in the interior of the sub to seal the ports 460, 465, 485, 490 after the assembly has been removed. Specifically, a shearable connection 575 between the motor/pump portions and the sleeve is caused to fail after the sleeve has assumed a second position whereby it covers the upper and lower ports. Additionally, a recessed area having a shoulder 520 at an upper end thereof permits the sleeve to remain in the interior of the sub while maximizing the inside diameter of the sub for the passage of cement and tools.

While the embodiment has been described with a fluid powered motor, the energy transfer assembly could also operate with a motor powered by other means, like electricity. In the case of an electric motor, a source of electricity can be provided by a conductor extending from the surface of the well or even by the casing itself if it is equipped to provide electrical power as in the case of wired pipe. Wired pipe and its uses are described in co-pending application Ser. No. 09/976,845, filed 12 Oct. 2001, and that specification is incorporated herein.

In yet another embodiment of the invention, the energy transfer device used to add energy to fluid circulating upwards in the annulus defined between a casing string and a borehole is a jet device which is run into the well entirely within the casing string. The principles of venturi-type jet are well known in the art and an example of a jet device used to reduce ECD is illustrated in FIG. 4 of copending application Ser. No. 10/156,722 which has been incorporated by reference herein. The jet device typically includes some type of restriction placable in the bore of the casing string which causes a back pressure of fluid traveling downwards in the casing. The back pressure causes a portion of the fluid to travel through openings that are provided in a wall of the casing and that fluid is directed through nozzles leading into the annular area defined between the casing string and the borehole. The remainder of the fluid continues downwards to the drill bit.

The nozzle typically includes an orifice and a diffuser portion. The geometry and design of the nozzle creates a low pressure area near and around the end of each nozzle. Because of fluid communication between the low pressure area and the annulus, some fluid below the nozzle is urged upward due to pressure differential. In this manner, energy is added to the fluid returning to the surface of the well and ECD is reduced. As with other embodiments described herein, the jet device is completely removable from the casing string after the borehole is formed by drilling with casing. Typically, like the other embodiments, the jet device, with its restriction is temporarily held within the interior of the casing by a latch assembly. An inwardly formed profile within the assembly is attachable to a run-in tool and upward force causes the latch assembly to become disengaged, permitting the jet device to be removed. Also, like other embodiments herein, a sleeve can be attached to a lower end of the jet device using a shearable connection which permits the sleeve to move upwards to a second position whereby it covers apertures that provided fluid communication between the inside and outside of the casing. With the sleeve in the second position covering the apertures, the shearable connection is caused to fail and the casing can be cemented in the borehole in a conventional manner.

As described and illustrated by the foregoing, the present invention provides an apparatus and methods to reduce ECD while drilling with casing in a manner that leaves the casing ready to be cemented in the wellbore. While the energy transfer assembly has been described according to a preferred design, the invention can be practiced with any type of assembly that uses a fluid traveling in one direction to act upon a flow of fluid traveling in an opposite direction.

What is claimed is:

1. A method of drilling with casing, comprising:

running the casing into a wellbore, the casing having a drilling member at a lower end to form a borehole as the casing is run; and utilizing an energy transfer assembly operatively connected to the casing, the energy transfer assembly adding energy to upwardly traveling fluid in an annulus defined between the casing and the wellbore.

2. The method of claim 1, further comprising removing the energy transfer assembly from the casing.

3. The energy transfer assembly of claim 1, wherein the drilling member and the energy transfer assembly utilize fluid from a common source.

4. The energy transfer assembly of claim 1, wherein the energy and the upwardly traveling fluid originate from a common source.

5. A method of reducing equivalent circulation density in a wellbore while towering casing in the wellbore, comprising:

forming the wellbore by running the casing into the wellbore, the casing including an energy transfer portion operatively connected thereto;

transferring energy with the energy transfer portion from fluid pumped down the casing to fluid circulating upwards in an annulus.

6. The method of claim 5, further comprising cementing the casing in the wellbore.

7. The method of claim 5, wherein the wellbore is formed using a drill bit located proximate the lower end of the casing.

8. A method for placing a casing in a wellbore comprising:

lowering the casing to form the wellbore; and pumping fluid into an area within a wall of the casing, the fluid circulating through an energy transfer assembly and to an area outside the wall, thereby adding energy to the fluid outside the wall.

9. The method of claim 8, further comprising placing a drill bit proximate the lower end of the casing to form the wellbore as the casing is placed in the wellbore.

10. The method of claim 8, wherein a portion of the casing comprises an energy transfer apparatus for transferring energy from one side of a wall of the casing to the other side of the wall.

11. A casing for lowering into a wellbore comprising:

a wellbore tubular with an interior forming a first communication path and an exterior forming a second communication path; and an energy transfer assembly operatively connected to the tubular for transferring energy between the interior and the exterior;

the energy transfer assembly capable of communicating with a power source through a third communication path, wherein the third communication path is isolated from the first and second communication paths.

12. A method of installing a casing string in a borehole, comprising:

lowering a tubular string of casing into the borehole, the tubular string including a housing for an energy transfer assembly:

installing, at a predetermined time, the energy transfer system into the housing;

operating the energy transfer system to add energy to a flow of wellbore fluid returning to a surface of the well in an annular area defined between the casing string the wellbore; and removing the energy transfer assembly from the casing string.

13. A method of drilling with casing, comprising:

running casing into a wellbore, the casing having a drilling member at a lower end to form a borehole as the casing is run;

utilizing an energy transfer assembly operatively connected to the casing, the energy transfer assembly adding energy to upwardly traveling fluid in an annulus defined between the casing and the wellbore;

removing the energy transfer assembly from the casing; and cementing the casing in the borehole.

14. A method of reducing equivalent circulation density in a wellbore while lowering casing in the wellbore, comprising:

running the casing into the wellbore, the casing including an energy transfer portion operatively connected thereto;

transferring energy with the energy transfer portion from fluid pumped down the string to fluid circulating upwards in an annulus; and selectively removing the energy transfer assembly from the casing.

15. The method of claim 14, further comprising sealing the casing as the energy transfer assembly is removed.

16. A method of installing a tubular in a wellbore, comprising:

lowering the tubular into the wellbore;

after at least partially lowering the tubular into the wellbore, installing an energy transfer assembly in the tubular; and while further lowering the tubular into the wellbore, operating the energy transfer assembly to add energy to a flow of fluid returning to a surface of the well in an annular area defined between the tubular and the wellbore.

17. The method of claim 16, further comprising removing the energy transfer assembly from the tubular.

18. The method of claim 16, wherein the tubular is casing.

19. The method of claim 18, further comprising forming the wellbore while lowering the casing into the wellbore.

20. A casing for lowering into a wellbore comprising:

a wellbore tubular having an interior and an exterior; and an energy transfer assembly operatively connected to the tubular for transferring energy between the interior and the exterior, the energy transfer assembly selectively removable from the tubular while lowering the tubular into the wellbore.

21. The casing of claim 20, wherein the energy transfer assembly is disposed completely within the interior of the tubular.

22. A casing assembly for lowering into a wellbore comprising:

a wellbore casing having an interior and an exterior;

an energy transfer assembly operatively connected to the casing for transferring energy between the interior and the exterior; and a drill bit connected to the wellbore casing.

23. The casing of claim 22, wherein the drill bit is connected to the lower end of the wellbore casing.

* * * * *